US010334889B2

(12) United States Patent
Hensel

(10) Patent No.: US 10,334,889 B2
(45) Date of Patent: Jul. 2, 2019

(54) ATHLETIC WEAR NURSING BRA

(71) Applicant: Just Bloomed, LLC, Media, PA (US)

(72) Inventor: Anne Hensel, Havertown, PA (US)

(73) Assignee: Just Bloomed, LLC, Media, PA (US)

( * ) Notice: Subject to any disclaimer, the term of this patent is extended or adjusted under 35 U.S.C. 154(b) by 0 days.

(21) Appl. No.: 15/722,200

(22) Filed: Oct. 2, 2017

(65) Prior Publication Data

US 2018/0092408 A1 Apr. 5, 2018

Related U.S. Application Data

(60) Provisional application No. 62/404,253, filed on Oct. 5, 2016.

(51) Int. Cl.

| | |
|---|---|
| ***A41C 3/04*** | (2006.01) |
| ***A41C 3/00*** | (2006.01) |
| ***A41C 3/12*** | (2006.01) |

(52) U.S. Cl.

CPC ..... *A41C 3/0057* (2013.01); *A41C 3/04* (2013.01); *A41C 3/12* (2013.01)

(58) Field of Classification Search

CPC ..... A41C 3/04; A41D 3/215
USPC ..... 2/104; 450/36, 30–33
See application file for complete search history.

(56) References Cited

U.S. PATENT DOCUMENTS 2,341,032 A * 2/1944 Freed ..... A41C 3/08 2/67
5,624,296 A * 4/1997 Weber-Unger ..... A41C 3/04 2/101
6,162,111 A * 12/2000 Heroff ..... A41C 3/08 2/69
6,645,041 B2 * 11/2003 Sørensen ..... A41C 3/04 2/104
2004/0143885 A1 * 7/2004 Rothman ..... A41C 3/04 2/104
2004/0166766 A1 * 8/2004 Schneider ..... A41D 1/215 450/36
2008/0022434 A1 * 1/2008 Adelman ..... A41D 1/215 2/104
2008/0026676 A1 * 1/2008 Rothman ..... A41C 3/08 450/36
2009/0265830 A1 * 10/2009 Hendrickson ..... A41D 1/215 2/104
2010/0068971 A1 * 3/2010 Hendrickson ..... A41C 3/04 450/31
2010/0068972 A1 * 3/2010 Hendrickson ..... A41C 3/04 450/36

(Continued)

OTHER PUBLICATIONS

Cadenshae, Activewear for Nursing Mums, New Zealand, Accessed: Jan. 19, 2018. www.cadenshae.co.nz/.

(Continued)

*Primary Examiner* — Gloria M Hale
(74) *Attorney, Agent, or Firm* — Schott, P.C.

(57) ABSTRACT

An exercise top that is designed for nursing women, whereby the garment is stylish, comfortable, adjustable, and functional as an exercise top, yet also allows a convenient, easy and discrete mechanism that allows the user to nurse a baby without disrobing in that there are several points of adjustability to the garment, as well as an outer release mechanism and an inner release mechanism, which allow the wearer to selectively expose a breast for nursing.

20 Claims, 11 Drawing Sheets

(56) References Cited

U.S. PATENT DOCUMENTS

| | | | | |
|---|---|---|---|---|
| 2011/0314587 | A1* | 12/2011 | Ritchie | A41C 3/04 2/104 |
| 2014/0273737 | A1* | 9/2014 | Cortese | A41D 1/205 450/31 |

OTHER PUBLICATIONS

Pena, Jayne, The Avolia Nursing Sports Tank, Avolia, 2015, Austin, Texas. Accessed: Jan. 19, 2018. www.kickstarter.com/projects/avolia/the-avolia-nursing-sports-tank/description.

* cited by examiner

ATHLETIC WEAR NURSING BRA

BACKGROUND

In recent years, it has become more popular and fashionable for woman to wear exercise clothing, and particularly yoga-type clothing, as an all-day attire. While there is an assortment of nursing-style tops for nursing women, there is not currently available a convenient and comfortable exercise-style top that is fashionable, provides support and is also configured for nursing. Furthermore, many of the features of this garment make it adjustable, which is also important and necessary for nursing woman. This garment is thus fashionable, comfortable, sweat-wicking, flattering, form-fitting (despite a changing form), supportive, and discrete, as it allows the user to nurse conveniently and quickly without exposing any more of her body than necessary.

SUMMARY OF THE INVENTION

The innovative Active Athlesiure Nursing Bras are designed in a way that makes nursing quick and easy while being adjustable and staying comfortable and stylish. The signature look of this nursing bra is that it looks like a sports top as it has an outside frame that covers the chest and stomach. However, this garment has easy to use fasteners to temporarily, quickly and easily release a portion of the breast for feeding. The garment is designed with a bra frame that is comprised of a comfortable compression fabric for extra support, and also has an inner lining for discrete and comfortable protection. There is a top half that covers the breast and a bottom half that covers the stomach.

DETAILED DESCRIPTION OF THE INVENTION

Figure 1:
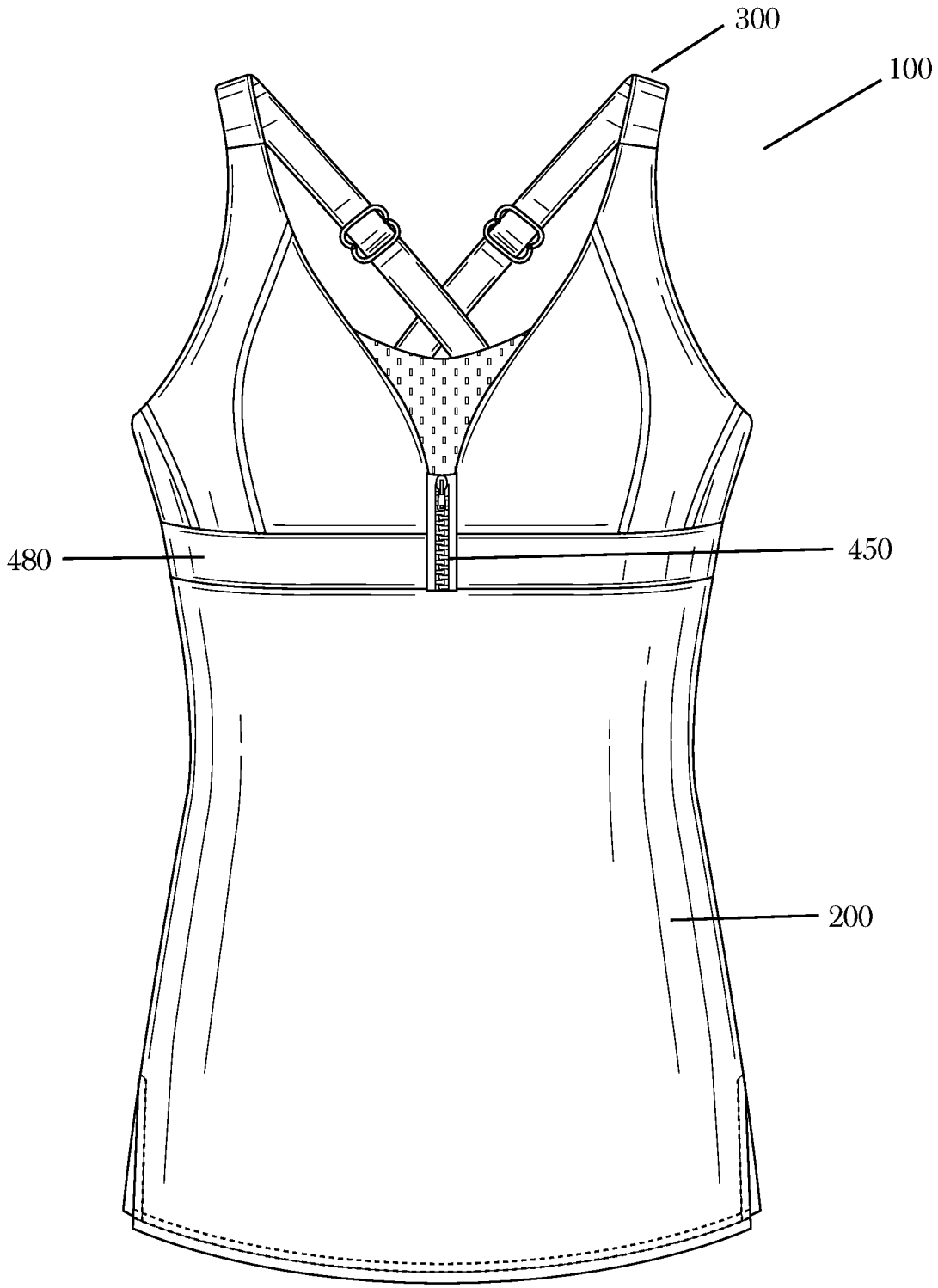
FIG. 1 illustrates a front view of the garment
Figure 2:
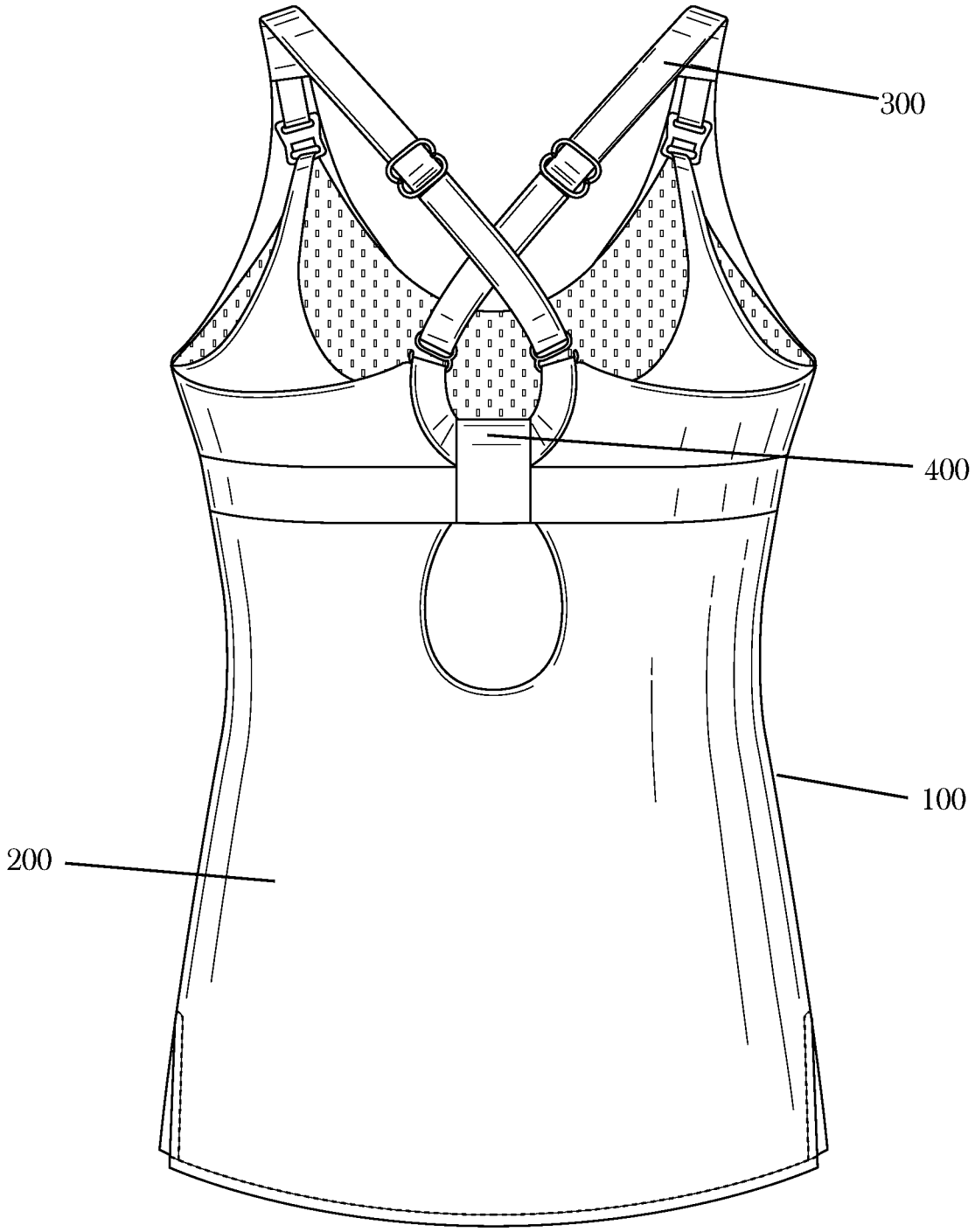
FIG. 2 illustrates a back view of the garment.
Figure 3:
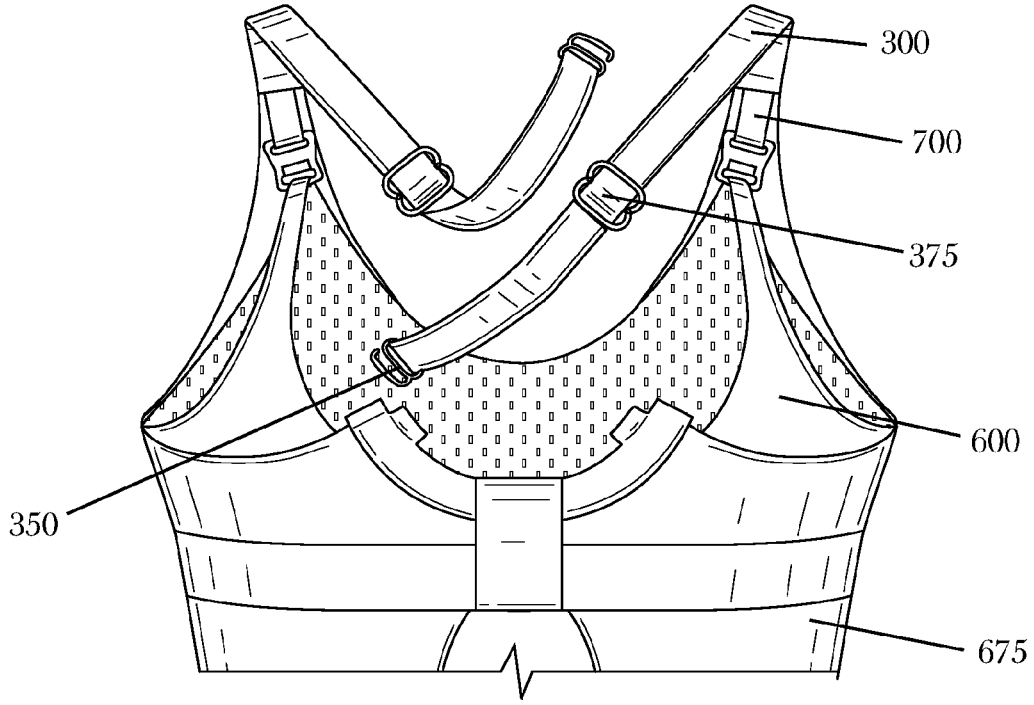
FIG. 3 illustrates a back view of the garment.
Figure 4:
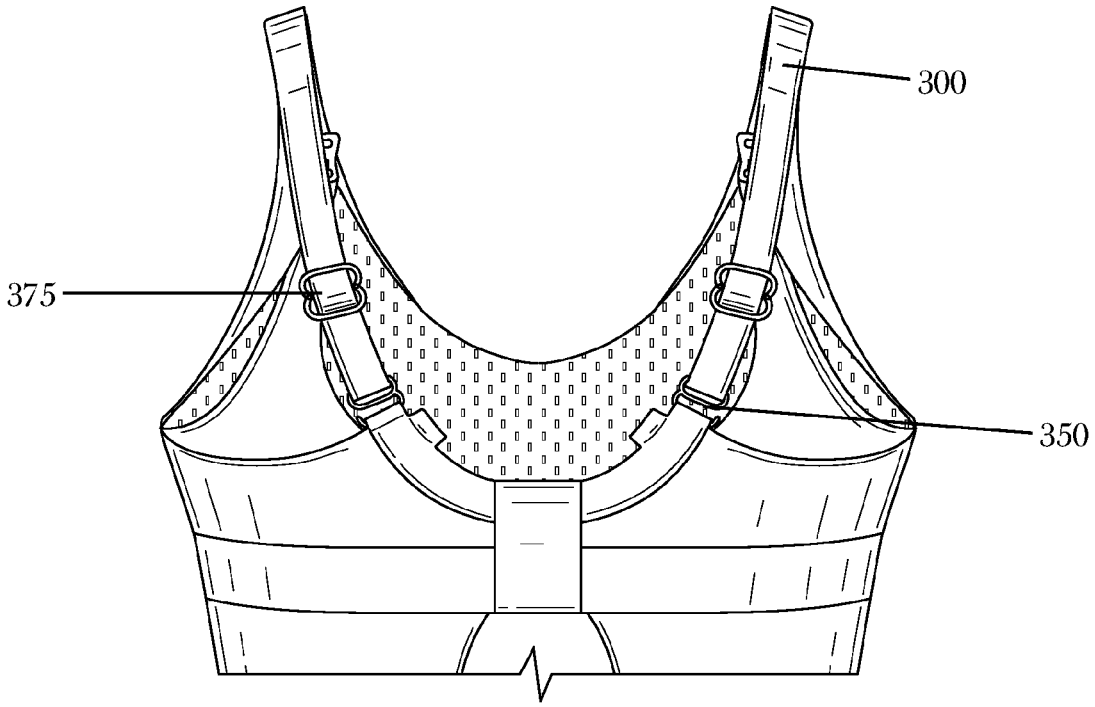
FIG. 4 illustrates another back view of the garment.
Figure 6:
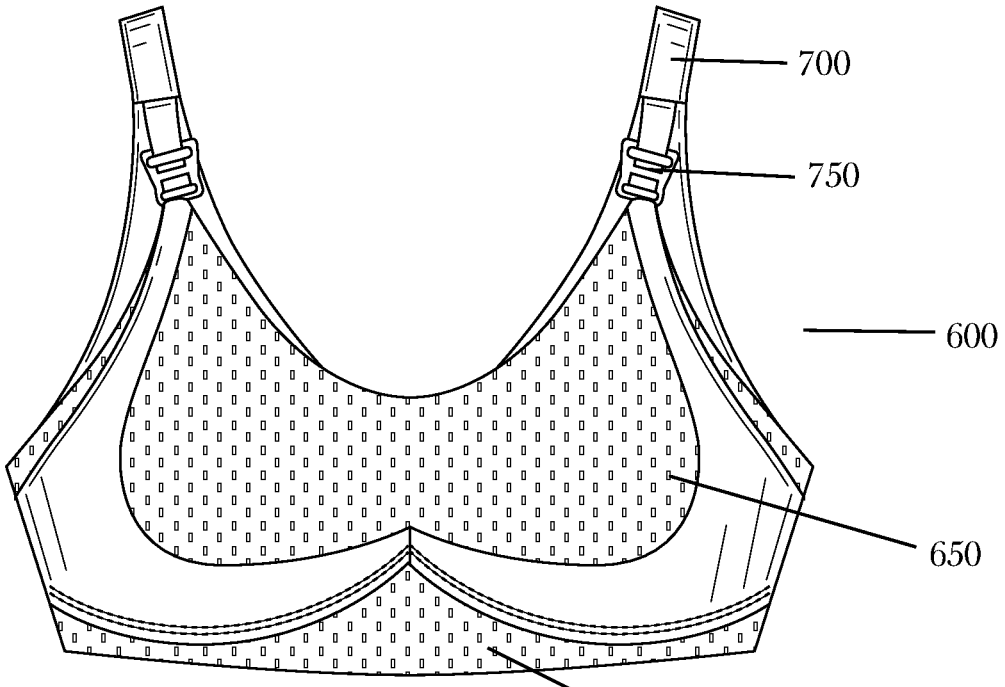
FIG. 6 illustrates a front view of the garment
Figure 7:
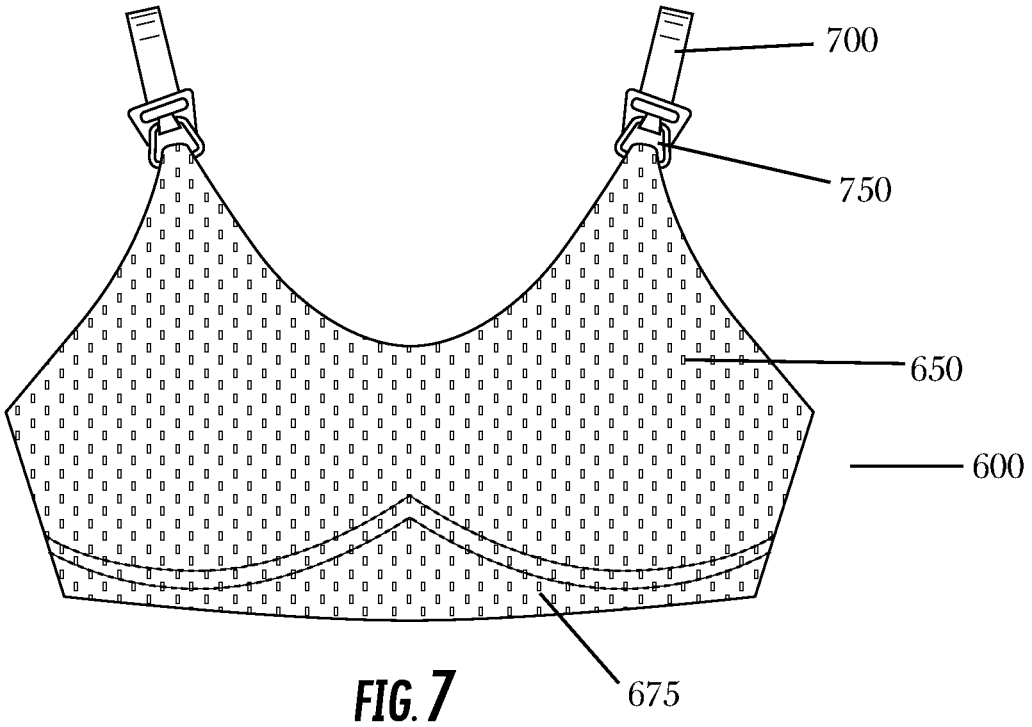
FIG. 7 illustrates another front view of the garment.
Figure 9:
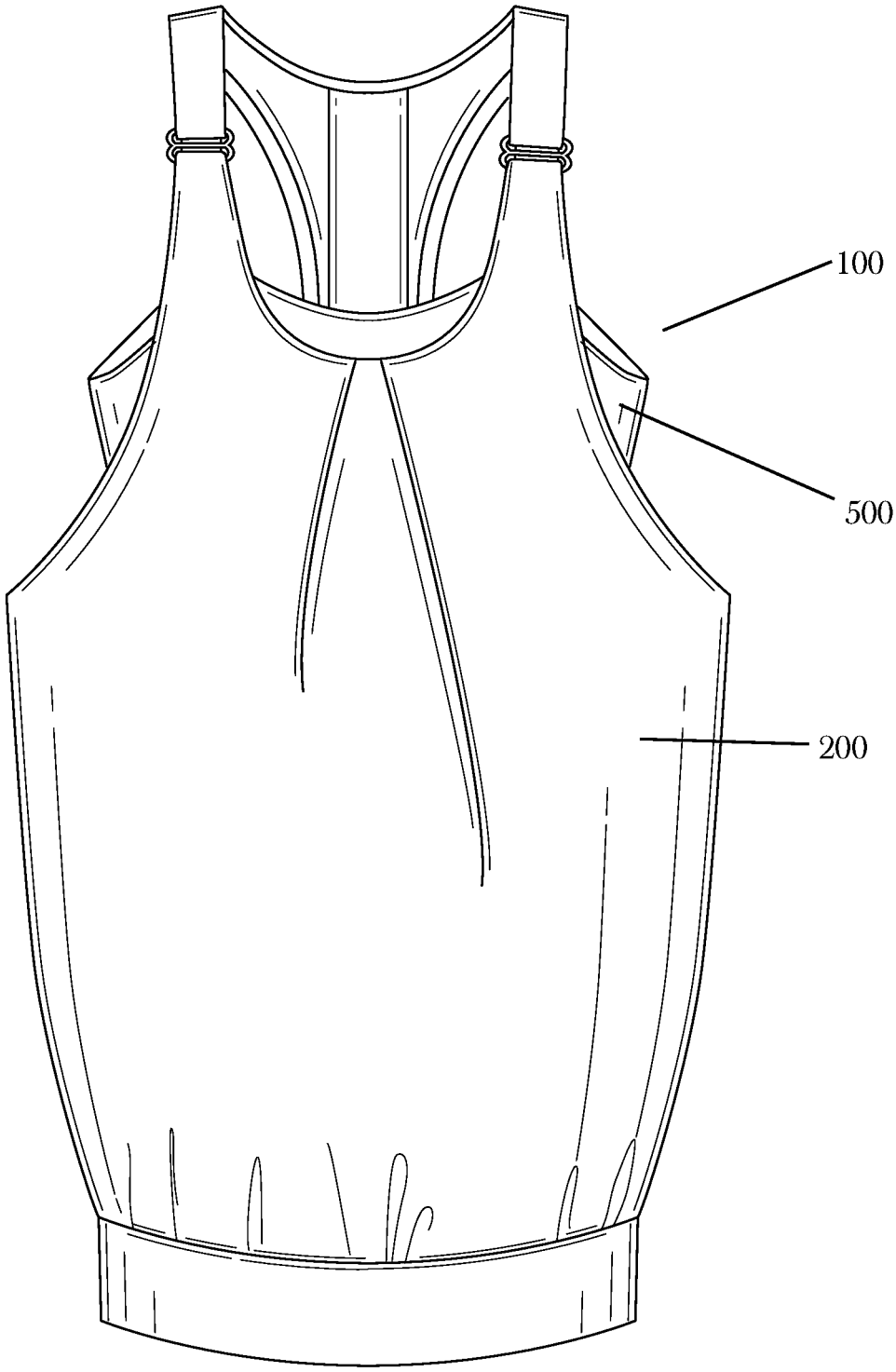
FIG. 9 illustrates another front view of another version of the garment.
Figure 10:
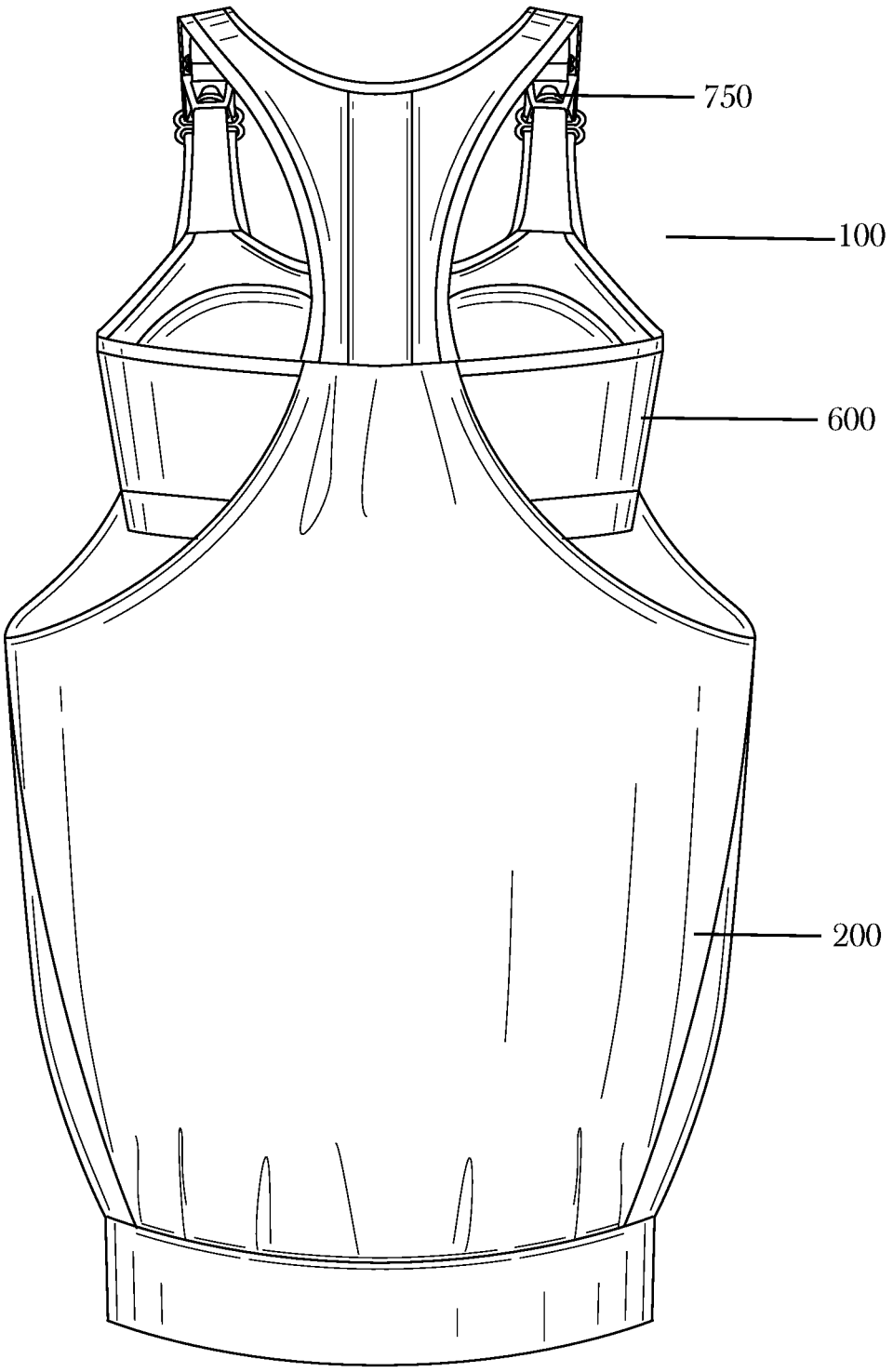
FIG. 10 illustrates another back view of another version of the garment.

As shown in FIGS. 1 and 9, the garment 100 comprises an athletic-style, nursing top for woman that allows easy and discrete nursing. The garment 100 can come in a sport-style, shown in FIG. 1, and a yoga style, shown in FIG. 9. Many features of the garment 100 make it adjustable to best suit the desired fit of the wearer. As best shown in FIGS. 1, 9 and 10, the garment 100 comprises an outer layer 200 and an inner layer 500. The inner layer 500 is attached to the outer layer 200 and includes a built in, wire-free bra 600, which bra is shown in FIGS. 6 and 7. The outer layer 200 includes shoulder straps 300. The straps 300 are adjustable both in length and in their configuration along the wearer's back. As shown in FIGS. 2-4, the shoulder straps 300 can be configured to be crossed in the back, in a racer-back style, or can be configured to not intersect, in a more traditional, muscle-tank configuration. The straps 300 are configured to thread through a loop or keyhole 400 on the back side of the outer layer 200. The shoulder straps 300 include latches 350 that allow the straps to be released or unhooked and re-configured as the wearer desires. The shoulder straps 300 also include a sliding mechanism 375 that allow the user to adjust the length of the straps 300 for a better, more comfortable fit. The sliding mechanism are particularly helpful to accommodate the changes in fit that may occur before and after nursing. The loop or keyhole 400 is also a stylish point of interest on the back outer layer 200 of the garment 100.

Figure 5:
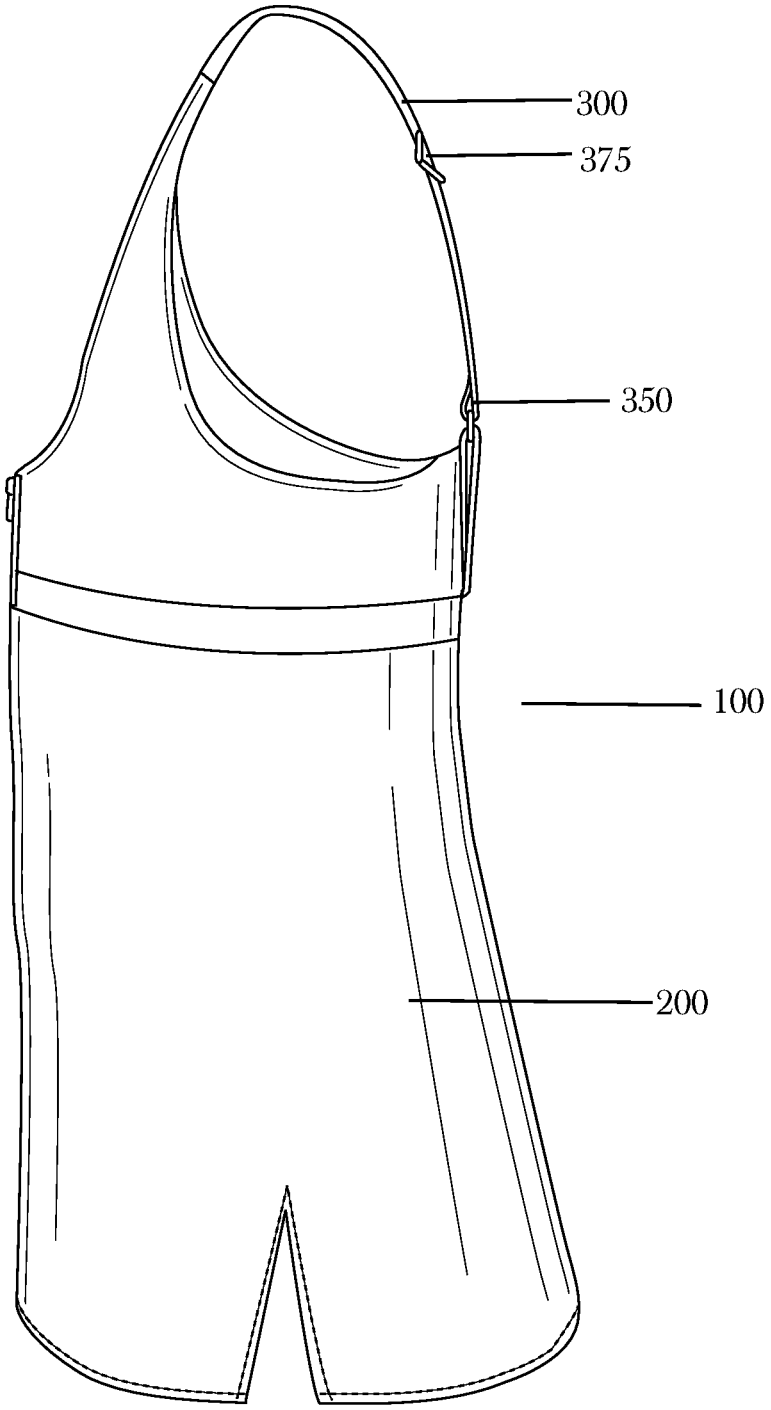
FIG. 5 illustrates a side view of the garment
Figure 11:
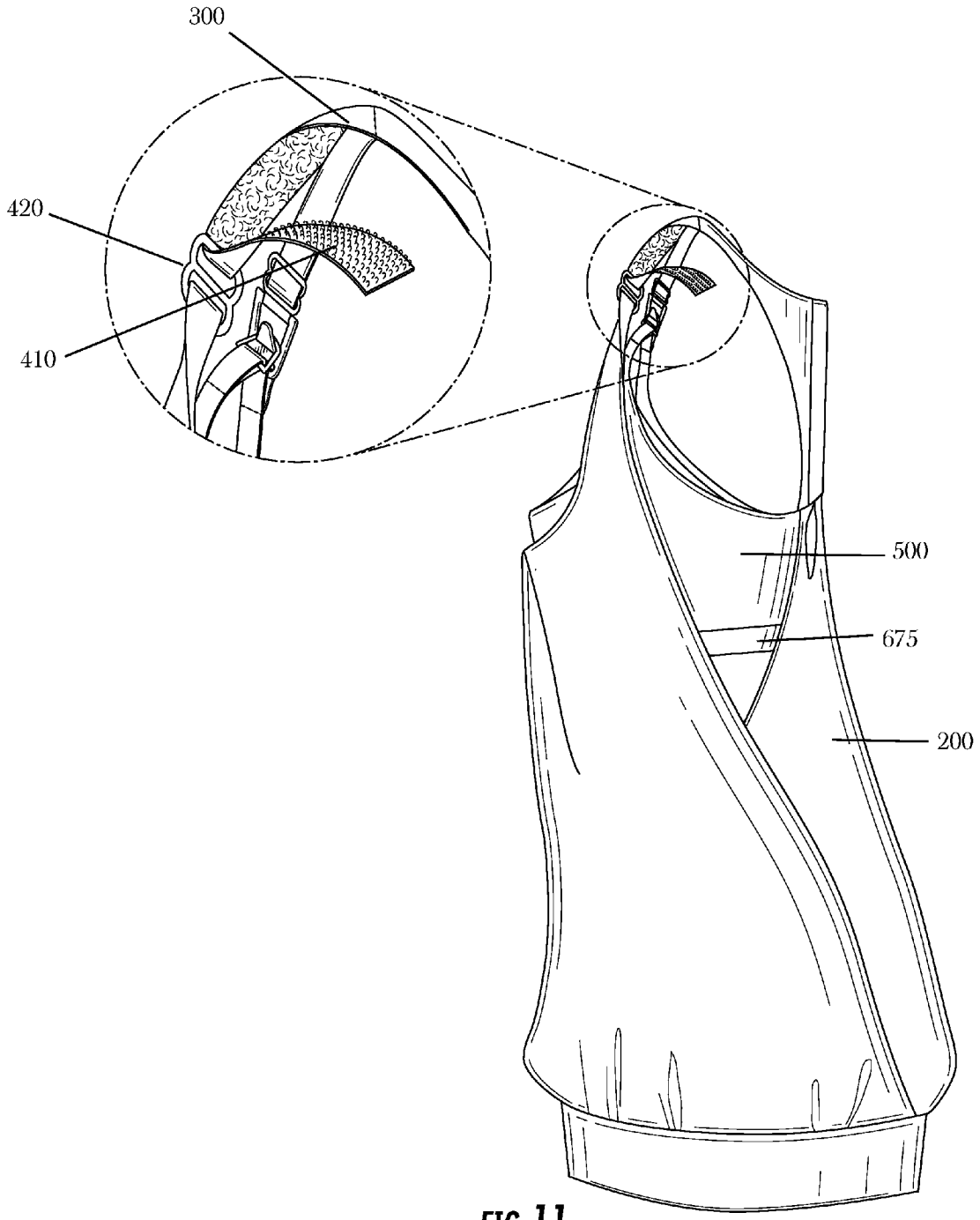
FIG. 11 illustrates another side view of another version of the garment.
Figure 12:
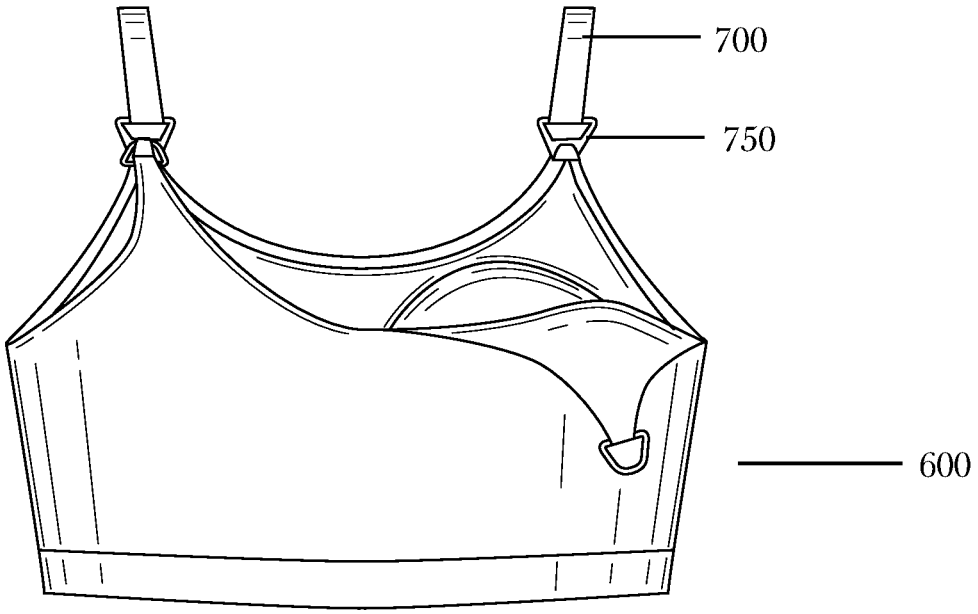
FIG. 12 illustrates another back view of the garment

As shown in FIG. 11, in some versions of the garment, the front side of the outer layer and the backside of the outer layer overlap. As shown in FIG. 5, in some versions of the garment, there is a side slit on a bottom edge of each side of the outer layer.

Figure 14:
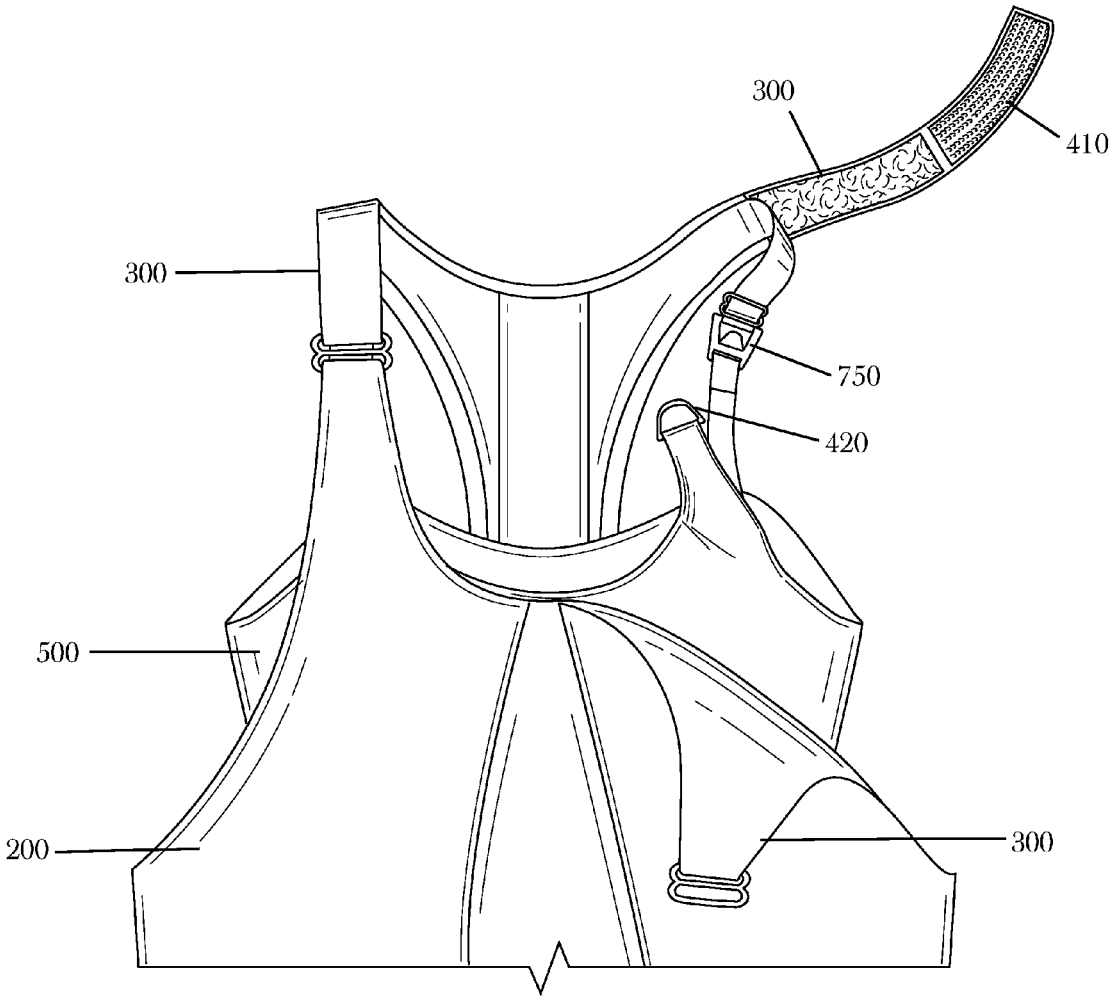
FIG. 14 illustrates another front view of the garment

In some versions of the garment 100, the straps 300 include hook and loop fastener 410 on the underside of the frontward facing part of the strap 300, which hook and loop fastener 410 serves as another mechanism for the user to adjust the length of the strap 300 and/or to unhook the strap 300, by feeding through a loop 420 and re-attaching to the underside of the strap. As shown in FIGS. 11 and 14, the hook and loop fastener mechanism allows the user to release one or both sides of the shoulder strap. This hook and loop fastener 410 thus allows for a better fit and comfort, which is especially important as the size and shape of the user's body changes, as happens for people that are nursing. The hook and loop fastener 410 is not visible when not released from the outer layer 200 of the garment 100, thereby masking the fact that the top is a nursing style top, which is another attractive feature of the garment. As one skilled in the art would appreciate, other similar releasable attachment mechanisms and fabrics could be used instead of hook and loop fastener.

Figure 8:
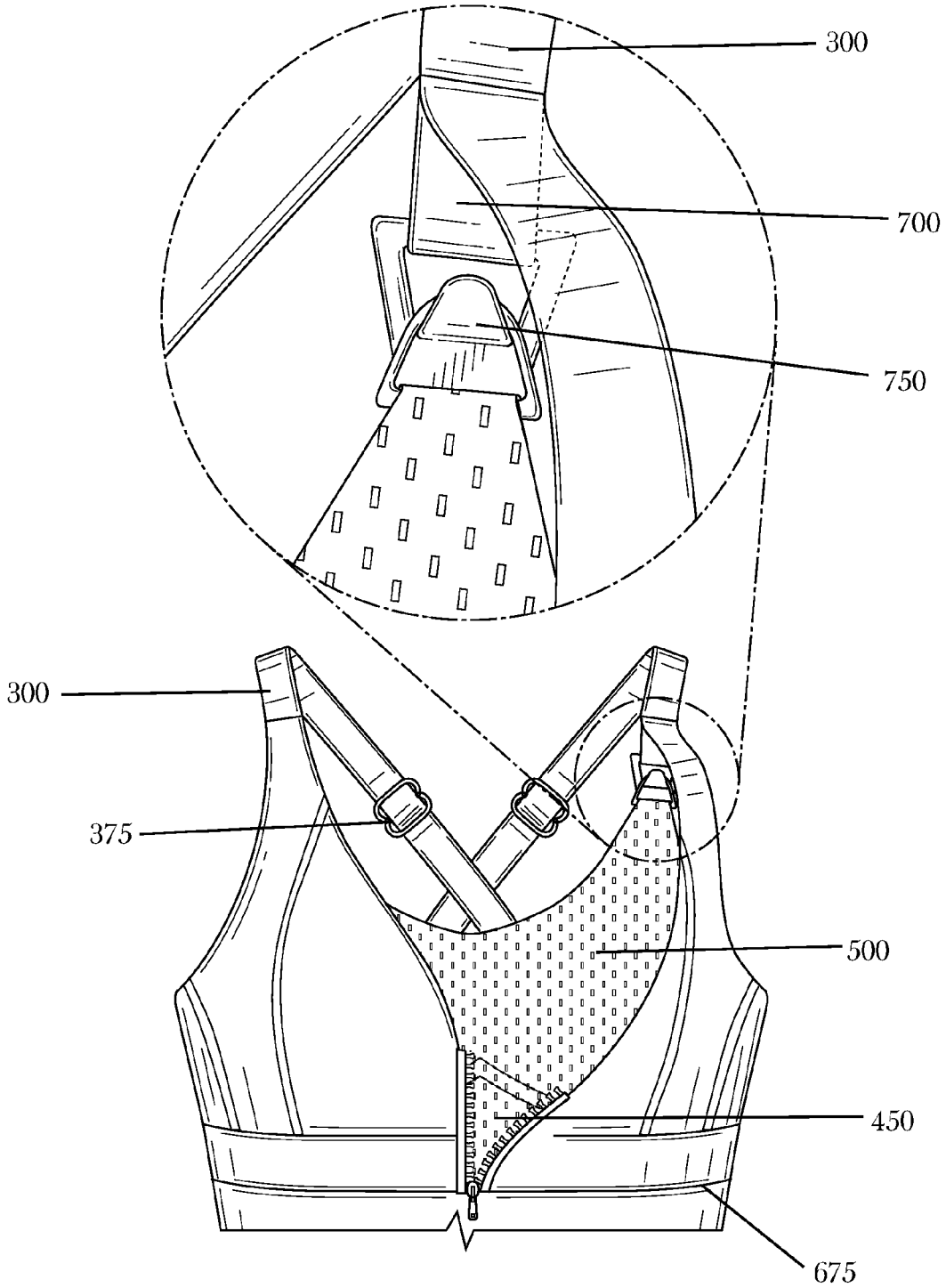
FIG. 8 illustrates another front view of the straps of the garment.

As shown in FIG. 1, in some versions of the garment 100, the outer layer 200 includes a zipper 450 on the front side, top, center edge. The zipper 450 is configured in the middle of the garment 100 and extends down toward the bottom of the nursing bra 600. As shown in FIG. 8, releasing the zipper 450 exposes the inner layer 500, including the inner straps of the nursing bra 600 and the clips that allow the release of the nursing bra, giving the wearer quick and easy access to one or both breasts. The zipper 450 is also a style detail, providing more interest to the front side of the garment 100. As one skilled in the art would appreciate, other similar releasable attachment mechanisms could be used instead of a zipper.

As shown, for example in FIGS. 1 and 11, the outer layer 200 may not completely cover the inner layer 500, particularly around the area of the nursing bra 600.

The outer layer 200 is configured from a standard material used for exercise clothing and includes sweat wicking characteristics, is light weight, washable and retains its shape even under duress or when wet. The material is breathable and can come in any assortment of colors and sizes, but is designed to fit a nursing woman. The outer layer 200 is configured to fully cover the torso of the wearer.

The outer layer 200 can be loose, as shown in FIG. 9, or configured to fit snug, as shown in FIG. 1. The outer layer may include a band 480 at its bottom edge, as shown in FIGS. 9-11. The band allows the outer layer 200 to sit snugly at the wearer's hips, and allows the outer layer 200 to blouse out around the band 480, for a flattering, stylish fit.

Figure 13:
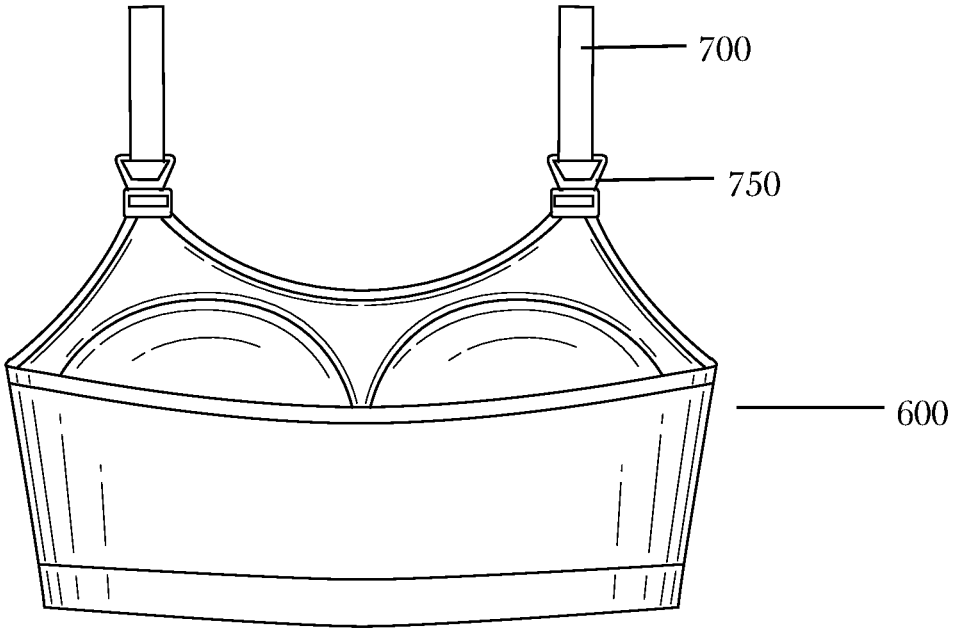
FIG. 13 illustrates another back view of the garment.

As shown in FIGS. 6 and 7, the bra 600 may be made of comfortable compression fabric and includes a liner 650 that is comprised of a material that is absorbent, comfortable, breathable, supportive and non-chaffing. The liner 650 may include a breathable fabric or a power mesh fabric, to provide for more comfort for the wearer. The mesh appearance of this fabric may be an additional design element of the garment 100. The bra 600 includes an elastic bra lower band 675 that encircles the bottom of the bra for increased bra support. As shown in FIG. 6, the band 675 may also not be of consistent width around the edge of the bra 600, and may rise up slightly between the user's breasts, for added support and to create a more flattering and defined fit. As shown in FIGS. 10 and 13, the bra 600 may also include an extra layer of absorbent nursing pads. These nursing pads may come in different sizes and shapes and may be removable and replaceable.

The bra 600 may also include a hook and eye closure mechanism 475 on the bottom edge of the back side of the bra. This provides another means to adjust the fit of the garment 100.

As shown in FIGS. 11 and 14, the bra 600 includes inner bra straps 700, one on each side, which bra straps 700 may serve to connect the bra 600 to an inside surface of the outer layer 200 of the garment 100. The bra straps 700 may be in the front of the bra 600 and are separate from the shoulder straps 300, but may be attached to an inner surface of the shoulder straps toward the top of the garment 100. The bra straps 700 include a release mechanism 750 and are independently releasable, meaning one bra strap can be released without releasing the other bra strap and/or can be released without releasing either shoulder strap 300. In this way, one side of the bra 600 can be released for nursing, without exposing any more of the wearer's body than necessary.

The bra strap release mechanism 750 can take many forms, including, but not limited to a hook and eye-type mechanism, a snap, buckle, or any similar mechanism. In one example, each of the bra straps 700 includes a rigid loop on one end of each of the straps, which loop catches on a hook that is located at a matching or corresponding point on an upper end of the bra strap 700. In another example, each of the bra straps 700 includes a rigid loop on one end of each of the straps, which loop terminates the bra strap 700 and catches on a hook that is located at a matching or corresponding point on the corresponding shoulder strap 300. The mechanism can be released quickly and easily with one hand. The mechanism is flat in profile, so as to not be visible through the outer layer 200. The bra straps 700 may also include a separate mechanism to adjust the bra strap's 700 length. The bra 600 may also be wholly separable from the outer layer 200 and worn as its own garment.

It should be understood that the foregoing relates to exemplary embodiments of the invention and that modifications may be made without departing from the spirit and scope of the invention as set forth in the following claims.

The invention claimed is:

1. A nursing top for woman comprising:
an inner layer and an outer layer,
the outer layer comprising shoulder straps,
the inner layer comprising a built in bra,
bra straps that connect the bra to the outer layer of the top, wherein an attachment mechanism is configured to hold and release the bra straps, wherein the bra straps are separate from the shoulder straps, wherein another mechanism is configured to adjust and release the shoulder straps,
an inner lining on the bra, the inner lining configured to be non-chafing and absorbent, and
a supporting elastic band encircling a bottom edge of the bra.

2. The nursing top according to claim 1, further comprising a zipper on a front side of the outer layer of the top, wherein release of the zipper exposes the attachment mechanism that includes inner hooks.

3. The nursing top according to claim 1, wherein the shoulder straps are adjustable and releasable to expose the attachment mechanism that includes inner hook.

4. The nursing top according to claim 1, wherein the shoulder straps further include a hook and loop fastener.

5. The nursing top according to claim 1, further comprising a front side and a back side, wherein the front side and the back overlap.

6. The nursing top according to claim 1, wherein the inner lining is cotton.

7. The nursing top according to claim 1, wherein there is a slit on a bottom edge of each side of the outer layer.

8. The nursing top according to claim 1, wherein the shoulder straps feed through a key-hole attached to a back side of the outer layer.

9. The nursing top according to claim 2 wherein the outer layer is configured to fit snug over a person's torso.

10. The nursing top of claim 1, wherein the bra straps are attached to an inner surface of the shoulder straps.

11. The nursing top of claim 10, wherein bra straps are attached to an inner surface of the shoulder straps in a top part of the nursing top.

12. A nursing top for woman comprising:
an inner layer and an outer layer,
the outer layer comprising shoulder straps,
the inner layer comprising a built in, wire-free bra,
bra straps that connect the bra to the outer layer of the top, wherein the bra straps are separate from the shoulder straps, wherein the shoulder straps feed through a keyhole attached to a back side of the outer layer,
an inner lining on the bra, the inner lining configured to be non-chafing and absorbent,
a supporting elastic band encircling a bottom edge of the bra, and
an attachment mechanism configured to hold and release the bra straps.

13. The nursing top according to claim 12, further comprising a zipper on a front side of the outer layer of the top, wherein release of the zipper exposes the attachment mechanism that includes inner hooks.

14. The nursing top according to claim 12, wherein the shoulder straps are adjustable and releasable to expose the attachment mechanism that includes inner hook.

15. The nursing top according to claim 12, wherein the shoulder straps further include a hook and loop fastener.

16. The nursing top according to claim 12, further comprising a front side and a back side, wherein the front side and the back overlap.

17. The nursing top according to claim 12, wherein the inner lining is cotton.

18. The nursing top according to claim 12, wherein there is a slit on a bottom edge of each side of the outer layer.

19. The nursing top of claim 12, wherein the bra straps are attached to an inner surface of the shoulder straps.

20. The nursing top of claim 19, wherein the outer layer is configured to fit snug over a person's torso.

* * * * *